US006019280A

United States Patent [19]

Peterson

[11] Patent Number: 6,019,280

[45] Date of Patent: Feb. 1, 2000

[54] C-FOLD RETURN POSTCARD MAILER

[75] Inventor: Wayne C. Peterson, Manchester, N.H.

[73] Assignee: Moore U.S.A. Inc., Grand Island, N.Y.

[21] Appl. No.: 09/223,776

[22] Filed: Dec. 31, 1998

[51] Int. Cl.[7] ..... B65D 27/06

[52] U.S. Cl. ..... 229/305; 229/92.3; 229/92.8; 229/300; 229/313

[58] Field of Search ..... 229/92.3, 300, 229/305, 313, 92.8

[56] References Cited

U.S. PATENT DOCUMENTS

| | | | |
|---|---|---|---|
| 1,043,243 | 11/1912 | Mitchell | 229/300 X |
| 1,134,082 | 3/1915 | Valasek | 229/300 X |
| 1,311,397 | 7/1919 | Herter | 229/92.8 |
| 1,998,354 | 4/1935 | Binger | 229/92.3 |
| 2,069,602 | 2/1937 | Davis | 229/92.3 |
| 2,768,780 | 10/1956 | Miller | 229/92.3 |
| 2,983,431 | 5/1961 | Turan | 229/300 X |
| 3,288,350 | 11/1966 | Kushner | 229/92.3 X |
| 3,726,471 | 4/1973 | Kalb . | |
| 4,089,418 | 5/1978 | Yale . | |
| 4,778,100 | 10/1988 | McGuire et al. . | |
| 4,892,246 | 1/1990 | Norman . | |
| 5,118,031 | 6/1992 | Tighe . | |
| 5,169,060 | 12/1992 | Tighe et al. . | |
| 5,201,464 | 4/1993 | File . | |
| 5,207,373 | 5/1993 | Tighe . | |
| 5,360,160 | 11/1994 | Sauerwine et al. . | |
| 5,366,145 | 11/1994 | Sauerwine . | |
| 5,553,774 | 9/1996 | Goodno . | |
| 5,785,242 | 7/1998 | Lombardo . | |

*Primary Examiner*—Jes F. Pascua
*Attorney, Agent, or Firm*—Nixon & Vanderhye P.C.

[57] ABSTRACT

A mailer type business form intermediate, and business form produced from the intermediate, have an included postcard which is used as a reply piece. The mailer may be a C-fold mailer, with a window (e.g. die cut-out) formed in one of the panels which overlies the outgoing address indicia formed on a face at the postcard. Check-off indicia is preferably provided on the postcard to optimize response, and tear-off strips along the side edges of the mailer are preferably held together with pressure sensitive cohesive. Tacking pressure sensitive adhesive may also be provided along edges of the die cut-out panel and the postcard-securing panel, exterior of the postcard.

20 Claims, 4 Drawing Sheets

C-FOLD RETURN POSTCARD MAILER

BACKGROUND AND SUMMARY OF THE INVENTION

In the utilization of mailer type business forms it is often desirable to include a reply piece with the form, and be able to simplex print the form with variable indicia. It is also desirable to make the mailer as simple and inexpensive as possible, such as formed from a single sheet of paper.

All of the above features are provided in the mailer type business form intermediate, and mailer type business form produced from the intermediate, according to the present invention. By providing a return postcard in one of the panels of the intermediate, and by providing a window in another of the panels which overlies a portion of the postcard on which the outgoing addressee's name may be variably printed, using a single sheet of paper about 14 inches by 8½ inches and having a weight that will travel through postal sorters without problems, an effective mailer with reply piece is provided. It has been demonstrated that the more a recipient of a mail piece needs to fill out the less likely he or she will complete the reply piece. Therefore by imaging the recipient's (outgoing addressee) name on the postcard, and by providing check-off indicia on the postcard, the reply piece can be filled out and returned with as little effort as possible, optimizing the probability that it will be returned. The mailer type business form according to the present invention is preferably formed by C-folding, although Z-folded or double folded constructions are also possible.

According to one aspect of the present invention, a business form intermediate is provided comprising the following components: A quadrate sheet of paper having first and second faces, substantially parallel top and bottom edges, and substantially parallel first and second side edges substantially perpendicular to the top and bottom edges. At least first and second fold lines substantially parallel to the top and bottom edges, and defining the sheet into at least first, second and third panels, the first panel disposed between the top edge and the first fold line, and the second panel disposed between the first and third panels. First and second lines of weakness extending substantially parallel to the side edges and adjacent thereto, and defining first and second tear-off strips. Adhesive patterns disposed in the first and second tear-off strips for holding the panels together when the sheet is folded about the fold lines. A postcard defined by postcard-defining lines of weakness formed in one of the second and third panels and comprising first and second faces corresponding to the sheet first and second faces. The postcard second face having reply address indicia imaged thereon, and having an area for outgoing address indicia on the first face thereof. And, a window formed in the first panel in alignment with the outgoing address indicia area when the panels are folded about the fold lines.

At some stage the business form intermediate is simplex printed to provide outgoing addressee (variable) indicia on the outgoing address indicia area. In a preferred embodiment of the invention the postcard is formed in the third panel, and the window and the outgoing address area become aligned when the sheet is C-folded about the first and second fold lines. For simplicity the window typically comprises a die cut-out, although it may have a glassine patch, or it may be formed in a transparentized section of the first panel instead of using a die cut-out. In the preferred embodiment the adhesive patterns are preferably pressure activated cohesive such as disclosed in U.S. Pat. No. 5,201,464 (the disclosure of which is hereby incorporated by reference herein), and tacking pressure activated cohesive is also typically and preferably formed on the third panel first face and adjacent the second fold line and on the first panel first face adjacent the top edge, and exterior of the postcard. Preferably check-off indicia is provided on the postcard first face, and so that the postcard will pass through conventional postage sorting equipment a sheet of paper from which the intermediate is made typically comprises about 38 pound Mead or 80 pound Tag stock, or other conventional postcard stock. The sheet is typically approximately 14×8.5 inches, although it may have lesser dimensions if the C-folding is eccentric and/or if the postcard is made slightly smaller.

According to another aspect of the present invention a mailer type business form is provided comprising the following components: At least first, second and third paper plies each having a top face and a bottom face, top and bottom edges, and first and second side edges. Aligned tear-off strips formed in the plies by lines of weakness. Adhesive patterns holding the plies together at the tear-off strips. The second ply top face adjacent the first ply bottom face, and the second ply bottom face adjacent the third ply top face. A postcard defined by postcard-defining lines of weakness formed in the second ply and comprising top and bottom faces corresponding to the second ply top and bottom faces. The postcard bottom face having reply address indicia imaged thereon, and having outgoing address indicia on the top face thereof. And, a window formed in the first ply in alignment with the outgoing address indicia.

The nature of the window, and the adhesive, preferably is as described above. Tacking pressure sensitive cohesive is preferably provided for holding the first and second plies together adjacent the top edges thereof, and exterior of the postcard. The postcard preferably includes check-off indicia on the top face thereof, and the first and second ply bottom edges are preferably formed by a first fold in a sheet of paper and the second and third ply top edges are formed by a second fold in a sheet of paper, the sheet preferably having the weight set forth above.

It is the primary object of the present invention to provide a simple yet effective mailer type business form intermediate, and business form made therefrom, which have optimum probability of a recipient returning the reply postcard, and are simple and easy to use, and inexpensive to produce. This and other objects of the invention will become clear from an inspection of the detailed description of the invention, and from the appended claims.

DETAILED DESCRIPTION OF THE DRAWINGS

Figure 1:
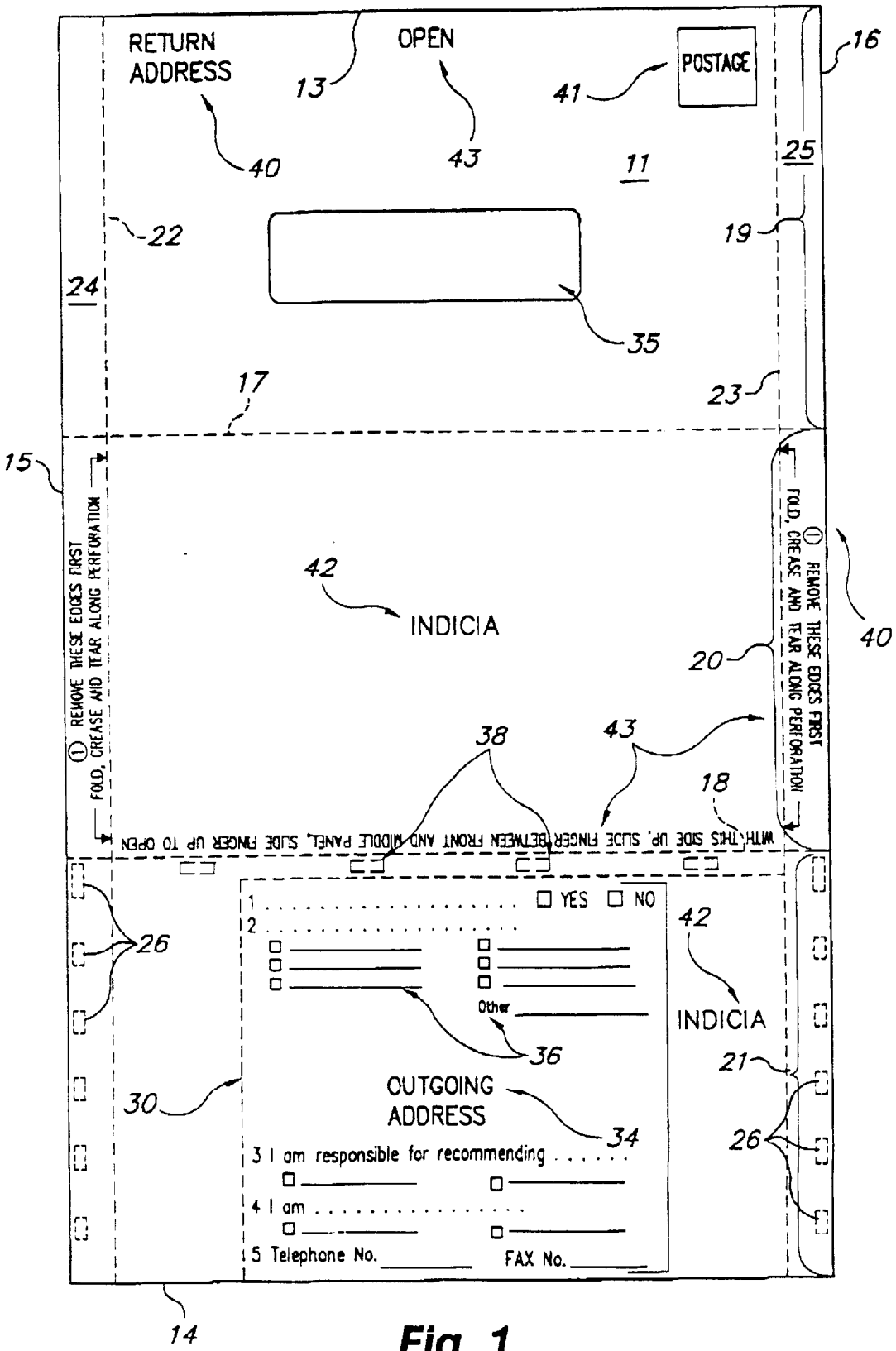
FIG. 1 is a top plan view of a first face of a mailer type business form intermediate according to the present invention.
Figure 2:
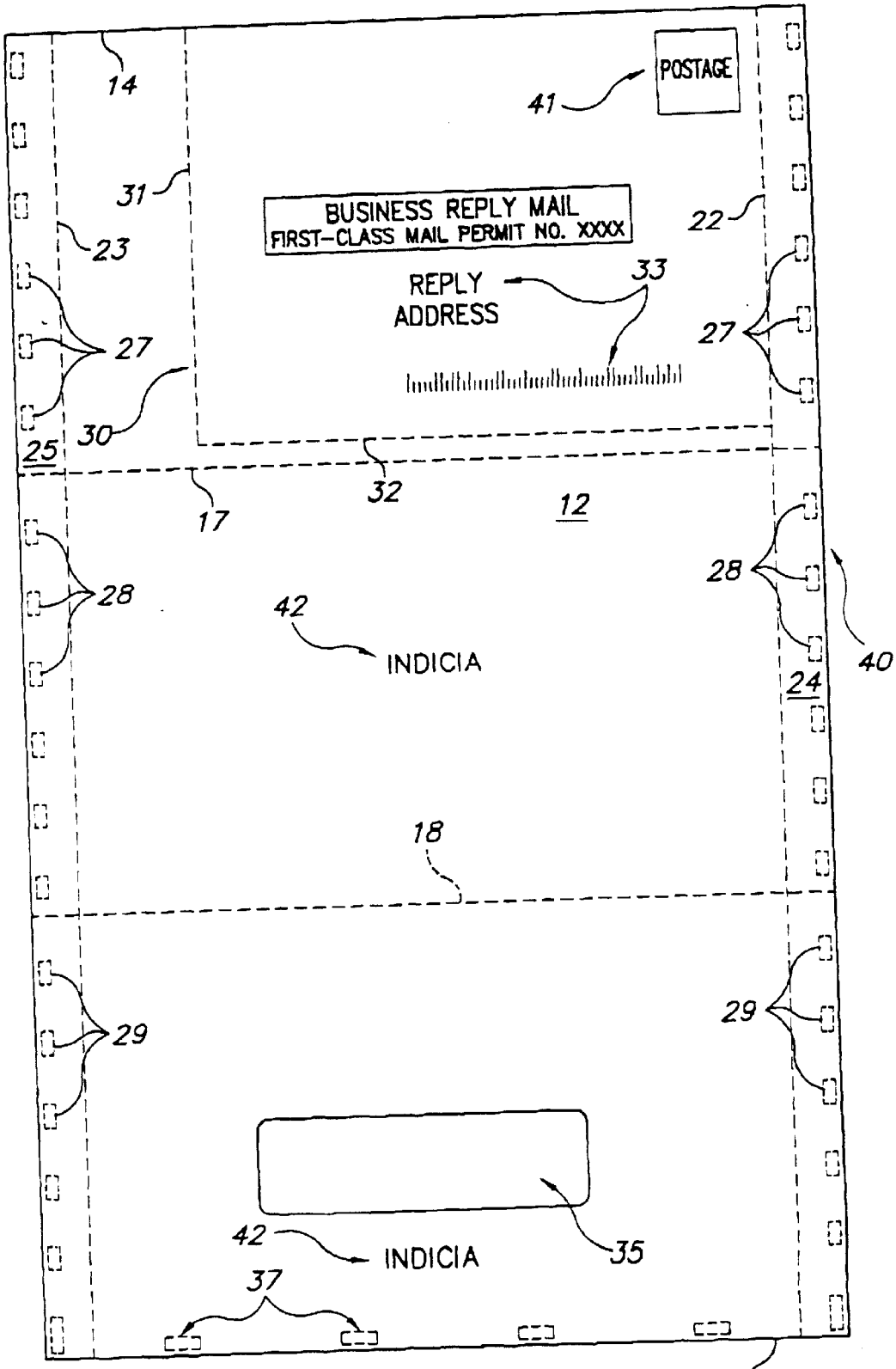
FIG. 2 is a top plan view of the second face of the intermediate of FIG. 1.
Figure 3:
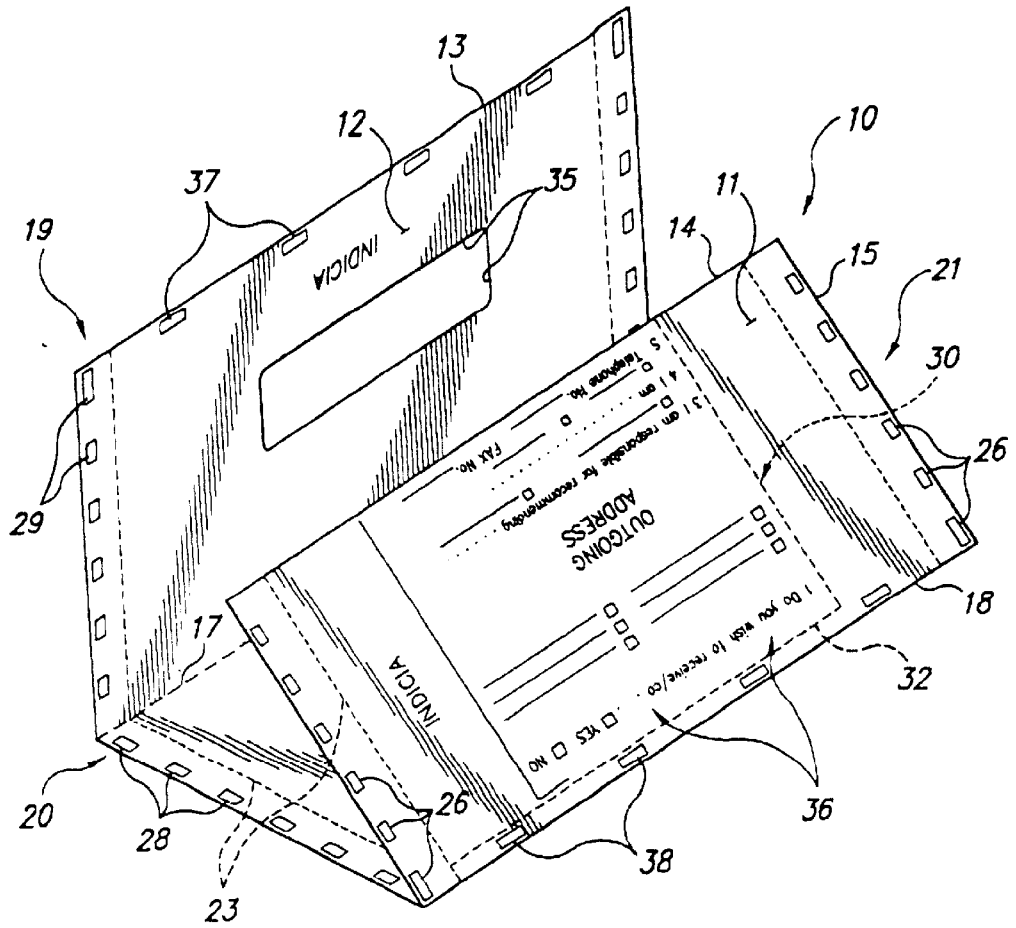
FIG. 3 is a perspective view illustrating C-folding of the intermediate of FIGS. 1 and 2 about the fold lines thereof to produce a mailer.

A mailer type business form intermediate according to the present invention is shown generally by reference numeral 10 in FIGS. 1 through 3. It is formed of a quadrate sheet of paper having a first face 11 (FIG. 1) and a second face 12 (FIG. 2), substantially parallel top and bottom edges 13, 14, respectively, and substantially parallel first and second side edges 15, 16, respectively, the side edges 15, 16 substantially perpendicular to the top and bottom edges 13, 14. In the preferred embodiment illustrated in the drawings, the sheet of paper forming the intermediate 10 preferably is a 14 inch by 8½ inch sheet of paper of sufficient weight so that a postcard separated therefrom can be properly handled by automated postal sorting equipment. For example the paper weight may be 38 pound per 1,000 sheet ream of 11×17 inch Mead paper, or 80 pounds per 1,000 sheet ream of Tag stock. While 8½×14 inch dimensions are preferred, dimensions may be different if an eccentric C (or Z) fold mailer is provided, or depending on the size of the postcard.

The intermediate 10 further comprises at least first and second fold lines 17, 18 substantially parallel to the top and bottom edges 13, 14 respectively and defining the sheet 10 into at least first, second, and third panels 19, 20, and 21, respectively. The first panel 19 is disposed between the top edge 13 and the first fold line 17, and the second panel 20 is disposed between the panels 19, 21, that is typically between the second and third fold lines 17, 18, while the third panel 21 is disposed between the second fold line 18 and the bottom edge 14 in the embodiment illustrated in the drawings.

The intermediate 10 further comprises first and second lines of weakness 22, 23, respectively, substantially parallel to the side edges 15, 16 and adjacent thereto, and defining first and second tear-off strips 24, 25. The lines of weakness may be any conventional lines of weakness, preferably perforation lines. Adhesive patterns are disposed in the tear-off strips 24, 25 for holding the panels 19 through 21 together when the sheet 10 is folded about the fold lines 17, 18. While a wide variety of adhesives may be provided, and different patterns including rewettable, heat activated, and like conventional adhesives, in a preferred embodiment according to the present invention the adhesive comprises pressure activated cohesive which is described in U.S. Pat. No. 5,201,464, the disclosure of which is hereby incorporated by reference herein. For example the adhesive patterns 26 may be provided in the strips 24, 25 in the first face 11 of the third panel 21 as illustrated in FIG. 1, the patterns 27 may be provided in the second face 12 of the first panel 19 in the strips 24, 25; the patterns 28 may be provided in the strips 24, 25 in the second panel 20 on the second face 12 thereof; and the patterns 29 may be provided in the strips 24, 25 in the third panel 21 on the second face 12 thereof, as illustrated in FIG. 2.

When the patterns 26–29 are provided as illustrated, when the intermediate 10 is (according to the embodiment illustrated in the drawings) C-folded about the lines 17, 18, the patterns 27, 28 cooperate with each other, and the patterns 26, 29 cooperate with each other, and are sealed to each other when passed through conventional pressure sealing equipment such as available from Moore U.S.A., Inc. of Lake Forest, Ill. The intermediate 10 further comprises a postcard 30 defined by a postcard-defining lines of weakness (e.g. perforation lines) such as the lines 31, 32. In the preferred embodiment illustrated, one of the lines of weakness is the second line of weakness 23 defining the tear-off strip 25, and another edge of the postcard 30 is formed by the bottom edge 14 of the intermediate 10. However if desired three or four distinct lines of weakness (comparable to lines 31, 32) may be provided to define the postcard 30. The postcard 30 has dimensions smaller than that of the panel 21, e.g. about 4–4.5 inches by 5.5–7 inches, or such as disclosed in U.S. Pat. No. 4,778,100. However other dimensions may be provided as desired.

The postcard 30 second face 12 (see FIG. 2) has reply address indicia 33 imaged thereon, and has an area for outgoing address (variable) indicia 34 (see FIG. 1) on the first face 11 thereof. The postcard 30 is preferably formed in one of the second or third panels 20, 21, respectively, preferably in the third panel 21 in the embodiment illustrated in the drawings. A window 35 is formed in the first panel 19 in alignment with the outgoing address indicia 34 (or area therefor) when the panels 19–21 are folded about the fold lines 17, 18 (e.g. C-folded as illustrated in FIG. 3). The window 35 may—as illustrated in the drawings—be formed by a simple die cut or it may have a glassine patch, or it may be formed by a transparentized portion of the first panel 19, or in any other way known in the art.

The postcard 30, in order to optimize the possibility that the recipient (the outgoing addressee 34) will complete and return the postcard 30, preferably includes check-off indicia 36 on the first face 11 thereof as seen in FIGS. 1 and 3.

Figure 4:
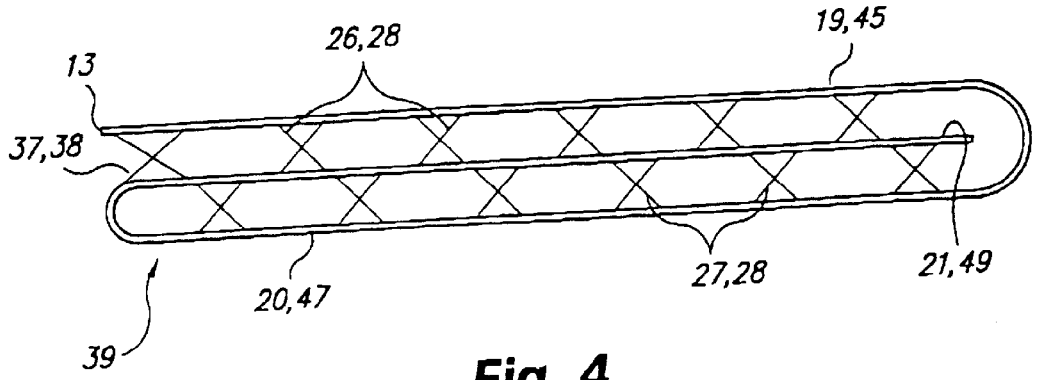
FIG. 4 is a side edge schematic view of the mailer produced by C-folding the intermediate as illustrated in FIG. 3.

In order to more positively secure the mailer formed by the intermediate 10, while still allowing ready opening thereof, tacking adhesive patterns are preferably also utilized to seal other portions aside from the side edges 15, 16. In the preferred embodiment illustrated in the drawing, mating (after C-folding) tacking adhesive patterns 37, 38 (see FIGS. 2 and 1, respectively) are provided, also of pressure activated cohesive. Tacking patterns 37, 38 differ from the sealing patterns 26–29 in that they are much more widely spaced so that a percentage of adhesive area provided thereby is much less than for the sealing adhesive. Only sufficient adhesive 37, 38 is provided to tack the intermediate 10 in the final mailer 39 (see FIGS. 4 and 5) configuration yet allowing ready opening thereof merely by the recipient sliding a finger or a pen or the like between the panels 19, 21 tacked together by the tacking patterns 37, 38. As illustrated in the preferred embodiment in the drawings, the pattern 37 is preferably adjacent the top edge 13 of the first panel 19 on a second face 12 thereof, while the pattern 38 is on the first face 11 of the third panel 21 adjacent the second fold line 18, and exterior of the postcard 30. Tacking adhesive is adhesive of the type and/or pattern such that the panels held together thereby may be readily separated without significantly destroying the panels.

Throughout the intermediate indicia may be provided as is desired, including the return address indicia 40 on the face 11 on the first panel 19, postage indicia 41 on the first face 11 of the first panel 19, and on the postcard 30 second face 12, and the various other indicia indicated generally at 42 provided on other panels to transmit desired fixed or variable information to the recipient of the mailer 39. Also instructional indicia 43 on how to open the mailer may be provided.

Figure 5:
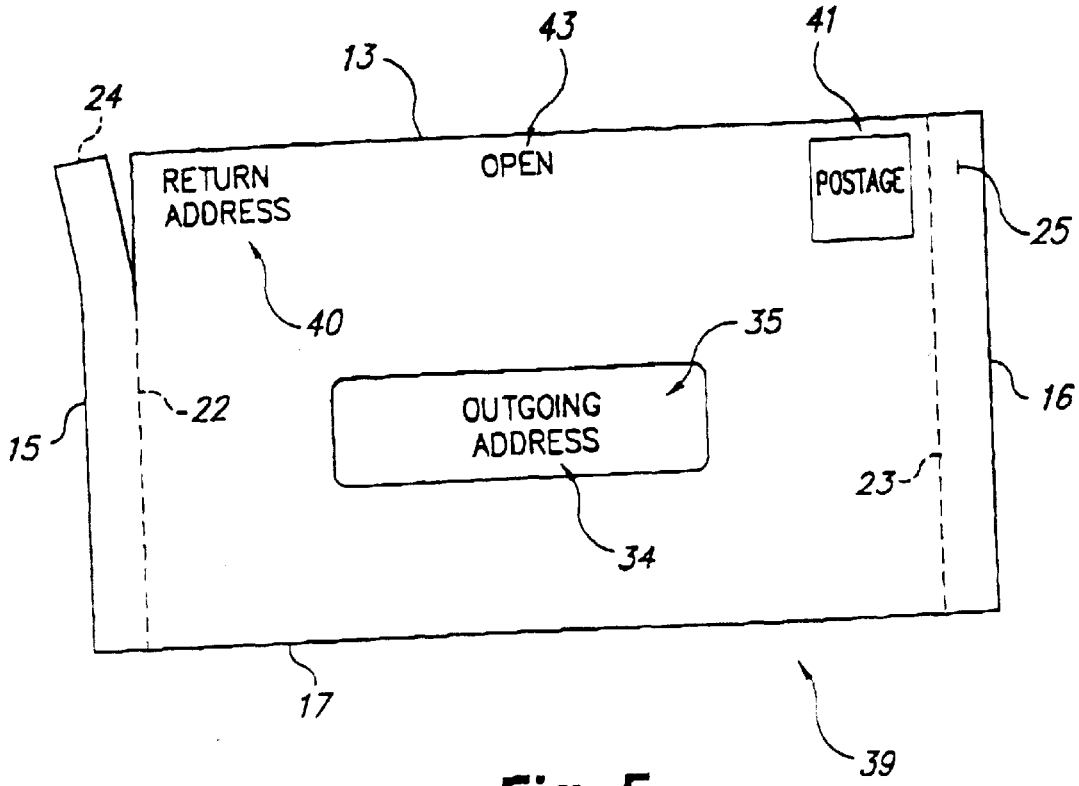
FIG. 5 is a top plan view of the mailer of FIG. 4 showing one of the tear-off strips being removed.
Figure 6:
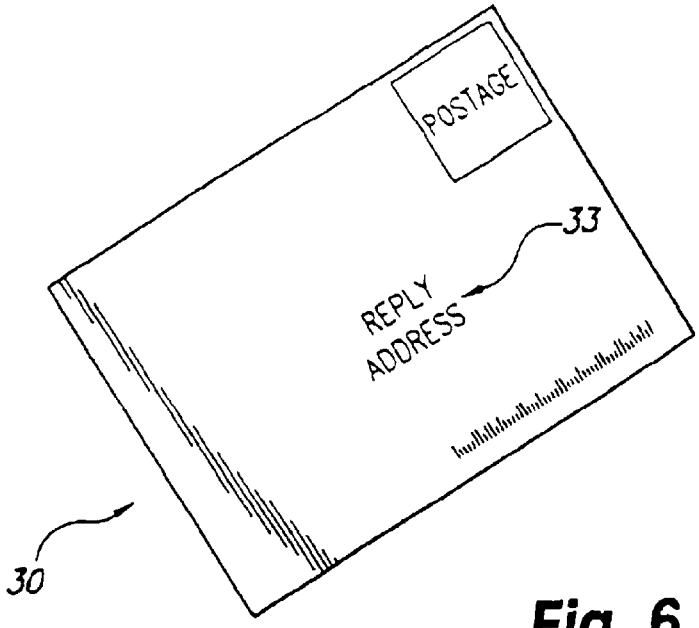
FIG. 6 is a perspective view of the postcard separated from the mailer of FIGS. 4 and 5 used as a reply piece.

While the intermediate 10 may be constructed so that Z-fold or double fold mailers 39 may be produced, according to the preferred embodiment, the mailer 39 is formed by C-folding about the fold lines 17, 18. For example as illustrated in FIG. 3 the third panel 21 is folded about a second fold line 18 so that the face 12 thereof comes into contact with the face 12 of the second panel 20, with the adhesive patterns 27, 28 aligned; and then the first panel 19 is folded out fold line 17 so that the second face 12 thereof comes into contact with the first face 11 of the third panel 21 with the outgoing address 34 visible through the window 35, as seen in FIG. 5, and patterns 37, 38 aligned.

In the formed mailer 39, the first panel 19 becomes the first ply, 45, of the mailer, and—assuming the intermediate is C-folded as illustrated in FIG. 3—the third panel 21 becomes the second ply, 46 and the second panel 20 becomes the third ply 47. The second face 12 of the first panel 19 comprises the bottom face of the top ply 45, while the first face 11 of the third panel 21 becomes the top face of the second ply 46, and the first face 11 of the second panel 20 comprises the bottom face of the third ply 47.

The mailer 39 is opened by tearing along the perforation lines 22, 23 to remove the tear strips 24, 25, and then by inserting his/her finger between the plies 45, 46 at the top edge 13 so that the recipient runs his/her finger parallel to the edge 13 to detach the tacking adhesive patterns 37, 38 from each other without destroying the plies associated therewith. This allows the entire mailer 39 to be unfolded, and then the postcard 30 is removed by tearing along the perforation lines 31, 32. The check list indicia 36 is filled out, and then the postcard 33 is placed in the mail and sent back to the reply address 33. Since the outgoing address/recipient's name 34 is imaged on the postcard 30 there is no reason or need for the recipient to write his/her name and address on the postcard 30 and thus the amount of information that needs to be filled out on the postcard 30 is minimized, and the probability that the recipient will fill it out and return it is maximized. Because the weight of the postcard 30 is sufficient for postal machine processing (e.g. about 80 Tag or about 38 pound Mead stock) the postcard 30 will stand up to conventional handling.

It will thus be seen that according to the present invention a mailer type business form intermediate and business form are provided which is advantageous compared to conventional mailers which utilize a reply, being simple, easy and inexpensive to make and use, and optimizing the probability that the recipient will return the reply component. While the invention has been herein shown and described in what is presently conceived to be the most practical and preferred embodiment, it will be apparent to those of ordinary skill in the art that many modifications may be made thereof within the scope of the invention, which scope is to be accorded the broadest interpretation of the appended claims so as to encompass all equivalent products and structures.

What is claimed is:

1. A mailer-type business form intermediate comprising:

a quadrate sheet of paper having first and second faces, substantially parallel top and bottom edges, and substantially parallel first and second side edges substantially perpendicular to said top and bottom edges;

at least first and second fold lines substantially parallel to said top and bottom edges, and defining said sheet into at least first, second and third panels, said first panel disposed between said top edge and said first fold line, and said second panel disposed between said first and third panels;

first and second lines of weakness extending substantially parallel to said side edges and adjacent thereto, and defining first and second tear-off strips;

adhesive patterns disposed in said first and second tear-off strips for holding said panels together when said sheet is folded about said fold lines;

a postcard defined by postcard-defining lines of weakness formed in one of said second and third panels and comprising first and second faces corresponding to said sheet first and second faces;

said postcard having reply address indicia imaged on said second face thereof, and having an area for outgoing address indicia on said first face thereof; and a window formed in said first panel in alignment with said outgoing address indicia area when said panels are folded about said fold lines.

2. A mailer type business form intermediate as recited in claim 1 further comprising outgoing address indicia imaged on said outgoing address indicia area.

3. A mailer type business form intermediate as recited in claim 2 wherein said postcard is formed in said third panel, and wherein said window and said outgoing address area become aligned when said sheet is C-folded about said first and second fold lines.

4. A mailer type business form intermediate as recited in claim 3 wherein said window comprises a die cutout.

5. A mailer type business form intermediate as recited in claim 3 wherein said adhesive patterns comprise pressure activated cohesive.

6. A mailer type business form intermediate as recited in claim 5 further comprising check-off indicia on said postcard first face; and wherein said sheet of paper comprises about 38 pound Mead or 80 pound Tag stock.

7. A mailer type business form intermediate as recited in claim 1 wherein said postcard is formed in said third panel, and wherein said window and said outgoing address area become aligned when said sheet is C-folded about said first and second fold lines.

8. A mailer type business form intermediate as recited in claim 5 further comprising tacking pressure activated adhesive formed on third panel first face adjacent said second fold line and exterior of said postcard, and on said first panel first face adjacent said top edge.

9. A mailer type business form intermediate as recited in claim 1 further comprising tacking pressure activated adhesive formed on third panel first face adjacent said second fold line and exterior of said postcard, and on said first panel first face adjacent said top edge.

10. A mailer type business form intermediate as recited in claim 1 wherein said sheet is approximately 14 by 8.5 inches, and wherein said sheet of paper comprises about 38 pound Mead or 80 pound Tag stock.

11. A mailer type business form comprising:

at least first, second and third paper plies each having a top face and a bottom face, top and bottom edges, and first and second side edges;

aligned tear-off strips formed in said plies by lines of weakness;

adhesive patterns holding said plies together at said tear-off strips;

said second ply top face adjacent said first ply bottom face, and said second ply bottom face adjacent said third ply top face;

a postcard defined by postcard-defining lines of weakness formed in said second ply and comprising top and bottom faces corresponding to said second ply top and bottom faces;

said postcard bottom face having reply address indicia imaged thereon, and having outgoing address indicia on said top face thereof; and a window formed in said first ply in alignment with said outgoing address indicia.

12. A mailer type business form as recited in claim 11 wherein said window is a die cutout.

13. A mailer type business form as recited in claim 11 wherein said adhesive patterns are pressure sensitive cohesive.

14. A mailer type business form as recited in claim 13 further comprising tacking pressure sensitive cohesive for holding said first and second plies together adjacent said top edges thereof, and exterior of said postcard.

15. A mailer type business form as recited in claim 14 further comprising check-off indicia on said post card top face.

16. A mailer type business form as recited in claim 15 wherein said first and second ply bottom edges are formed by a first fold in a sheet of paper, and said second and third ply top edges are formed by a second fold in said sheet of paper, said paper comprising approximately 38 pound Mead or 80 pound Tag stock.

17. A mailer type business form as recited in claim 12 wherein said adhesive patterns are pressure sensitive cohesive.

18. A mailer type business form as recited in claim 11 further comprising tacking pressure sensitive cohesive for holding said first and second plies together adjacent said top edges thereof, and exterior of said postcard.

19. A mailer type business form as recited in claim 11 further comprising check-off indicia on said post card top face.

20. A mailer type business form as recited in claim 11 wherein said first and second ply bottom edges are formed by a first fold in a sheet of paper, and said second and third ply top edges are formed by a second fold in said sheet of paper.

* * * * *